United States Patent [19]

Bar-On et al.

[11] 4,117,442

[45] Sep. 26, 1978

[54] DIFFERENTIAL-TEMPERATURE-SENSITIVE DEVICE

[76] Inventors: Benjamin Bar-On, 15 Hacarmel St., Rishon Lezion; Eldad Paz, 9 Haysar St., Ramat Hasharon, both of Israel

[21] Appl. No.: 763,915

[22] Filed: Jan. 31, 1977

[51] Int. Cl.[2] ..... H01H 37/46

[52] U.S. Cl. ..... 337/397; 337/393

[58] Field of Search ..... 337/397, 393, 388, 384

[56] References Cited

U.S. PATENT DOCUMENTS 2,549,054 4/1951 Burling ..... 337/397

FOREIGN PATENT DOCUMENTS 672,673 12/1939 Fed. Rep. of Germany ..... 337/384

*Primary Examiner*—Harold Broome

*Attorney, Agent, or Firm*—Benjamin J. Barish

[57] ABSTRACT

A differential-temperature-sensitive device particularly useful for controlling an electrical switch in response to a difference in temperature comprises a first lever arm pivotably mounted at one end to a base member, a second lever arm pivotably mounted to the opposite end of the first arm, and a pair of temperature-sensitive elements each coupled to one of said lever arms for pivoting same in response to the temperature sensed, the control member, preferably an electrical switch, being actuated by the opposite end of the second lever arm.

10 Claims, 2 Drawing Figures

DIFFERENTIAL-TEMPERATURE-SENSITIVE DEVICE

BACKGROUND OF THE INVENTION

The present invention relates to differential-temperature-sensitive devices. The invention is particularly useful for actuating an electrical switch in response to a temperature-differential, and is therefore described below with respect to such an application.

There are many applications for differential-temperature-sensitive switches. One application is in a solar heating system, wherein a pump is actuated to pump hot water from the solar collector to the hot water storage tank, only when the water in the solar collector has been heated to a predetermined temperature differential with respect to the water in the water storage tank. Heretofore, such differential-temperature-sensitive devices have generally included electrical circuitry for measuring the temperature differential. Mechanical-type differential-temperature-sensitive devices have also been proposed, as illustrated for example in U.S. Pat. No. 2,549,054, but as a rule the known types have been of relatively complicated and costly construction. An object of the present invention is to provide a mechanical differential-temperature-sensitive device of simple and inexpensive construction for measuring the temperature differential and for actuating a controlled member, particularly an electrical switch, in response to the measured temperature differential.

BRIEF SUMMARY OF THE INVENTION

According to the present invention, there is provided a differential-temperature-sensitive device comprising a base member, a first lever arm pivotably mounted at one end to the base member, a second lever arm pivotably mounted at one end to the opposite end of the first arm, a first temperature-sensitive element coupled to the first arm to pivot same with respect to the base member in response to the temperature sensed, by that element, and a second temperature-sensitive element coupled to the second arm to pivot same with respect to said opposite end of the first arm in response to the temperature sensed by that element. A control member, preferably an electrical switch fixed to the base, is actuated by the opposite end of the second arm.

In the described preferred embodiment, each of the temperature-sensitive elements includes a rod disposed within a sleeve and fixed thereto at one of their ends. The opposite end of each sleeve is fixed to the base member, and the opposite end of each rod passes through the base member, and is coupled to its respective lever arm.

As will be described more particularly below, when both of the temperature-sensitive elements sense substantially the same temperature, whether hot or cold, the electrical switch is not actuated; but when the first temperature-sensitive element is hot and the second one is cold, the electrical switch is actuated.

The invention thus provides a simple and inexpensive mechanical differential-temperature-sensitive switch which can be used in many different applications, particularly the one briefly mentioned above.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF THE PREFERRED EMBODIMENT

Figure 2:
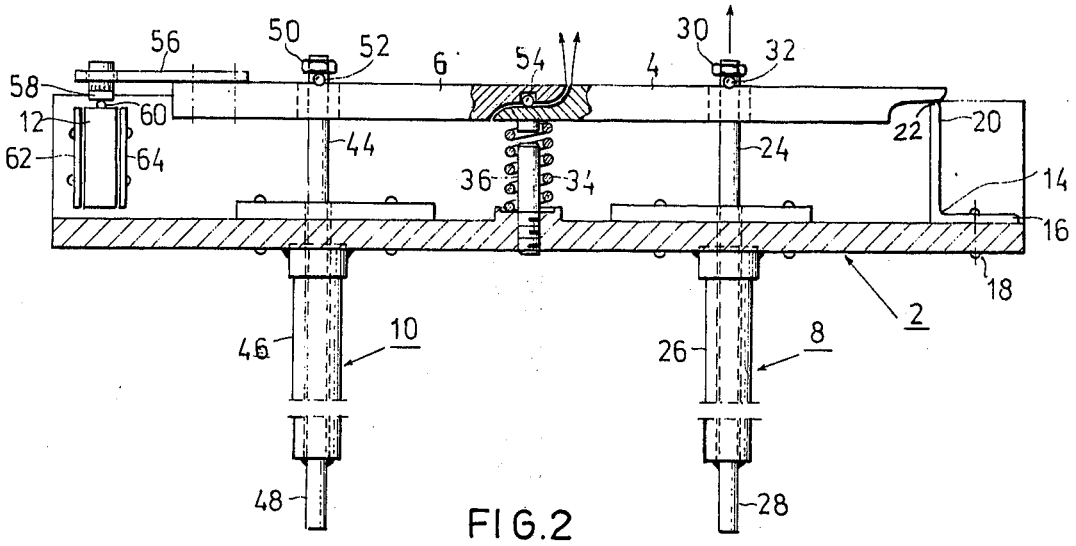
FIG. 2 is a longitudinal sectional view along lines II—II of FIG. 1.
Figure 1:
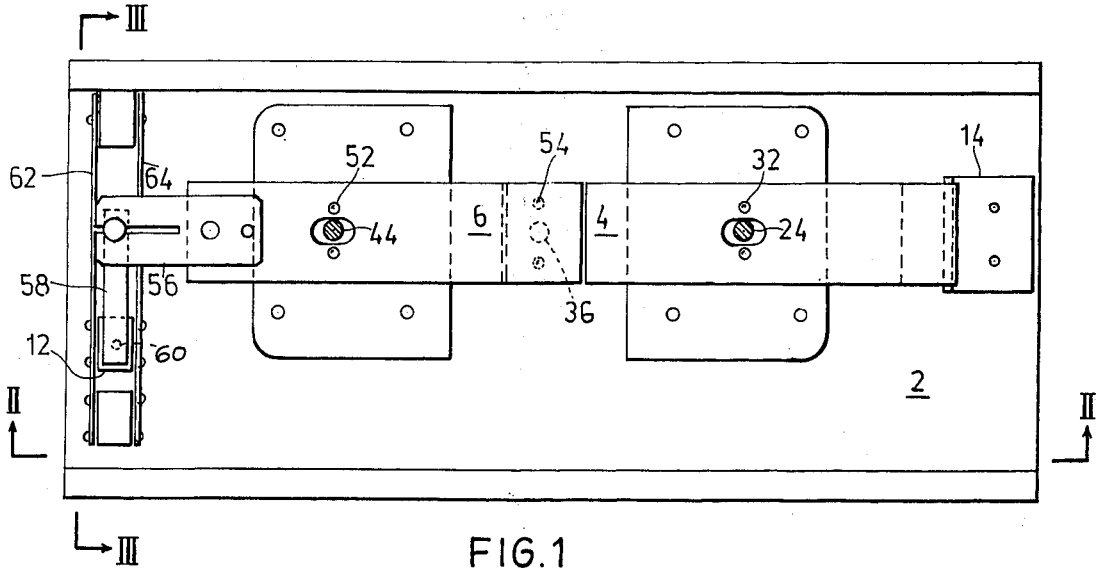
FIG. 1 is a top plan view of a differential-temperature- sensitive switch constructed in accordance with the invention.
Figure 3:
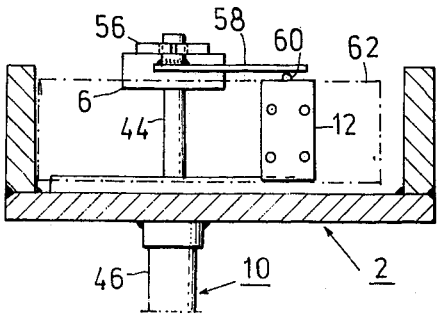
FIG. 3 is a transverse sectional view along lines III—III of FIG. 1.

The differential-temperature-sensitive electrical switch illustrated in the drawings comprises a base member 2 having a first lever arm 4 pivotably mounted at one end to the base member, and a second lever arm 6 pivotably mounted to the opposite end of the first arm 4. A temperature-sensitive element, generally designated 8, is coupled to the first arm 4 to pivot same with respect to the base member 2 in response to the temperature sensed by this element; and a second temperature sensitive element, generally designated 10, is coupled to the second arm 6 to pivot same with respect to arm 4 in response to the temperature sensed by element 10. An electrical switch, generally designated 12, is actuated by the free end of arm 6.

More particularly, one end of lever arm 4 is pivoted to base member 2 by means of an L-shaped lug 14 having a leg 16 attached by a fasterner 18 to the base member, and a second up-standing leg 20 rounded at its upper free end 22 to serve as a fulcrum for lever arm 4.

Temperature-sensitive element 8 is of a known type, including a rod 24 disposed within a sleeve 26, both the rod and sleeve being of metal but having different temperature coefficients of expansion. The lower end 28 of the rod 24 is fixed to the sleeve 26. The upper end of the sleeve 26 is fixed to the underside of the base member 2. The upper end of rod 24 passes through an opening in the base member and a further opening in its lever arm 4 and receives a nut 30 which serves as an enlarged head. A bearing 32 is interposed between nut 30 and lever arm 4. The opposite end of lever arm 4 (i.e., the end opposite to fulcrum 22) is urged in the clockwise direction by means of a spring 34 coaxially received on a pin 36 fixed to the base member 2.

The arrangement is such that when element 8 senses a relatively hot temperature, its rod 24 expands, thereby permitting spring 34 to pivot lever arm 4 clockwise on fulcrum 22; and when it senses a relatively low temperature, rod 24 contracts, thereby pivoting lever arm 4 counter-clockwise on fulcrum 22.

Temperature-sensitive element 10 is of the same construction as element 8 and is coupled to its respective lever arm 6 in the same manner. Thus, temperature sensitive element 10 also includes a rod 44 fixed at its lower end 48 within a sleeve 46, the opposite end of rod 44 passing through an opening in its lever arm 6 and receiving a nut 50 with a bearing 52 interposed between the nut and the lever arm. A further bearing 54 is interposed between the overlapping ends of the two lever arms 4 and 6. The opposite end of lever arm 6 carries a bracket 56 which supports a further arm 58 that actuates the operator 60 of electrical switch 12.

Preferably, the electrical switch is a micro-switch having a casing with its operator 60 projecting through the casing for actuation by arm 58. The electrical switch is mounted to the upper side of base member 2 by a pair of mounting brackets 62, 64.

The operation of the device illustrated in the drawings will be apparent from the above description. Thus, when both of the temperature-sensitive elements 8 and 10 sense substantially the same temperature, whether hot or cold, neither of the lever arms will be pivoted on their respective fulcrums 22, 54, and micro-switch 12 will therefore not be actuated. If element 8 senses a hot temperature and element 10 senses a cold temperature lever arm 4 will be pivoted clockwise about its fulcrum 22, and lever arm 6 will be pivoted counter-clockwise about its pivot 54, whereby the opposite end of lever arm 6 will depress bracket 58 to actuate operator 60 of micro-switch 12. On the other hand, if element 8 senses a cold temperature and element 10 senses a hot temperature, lever arm 6 will be pivoted clockwise about pivot 54, so that the micro-switch is not actuated.

Accordingly, micro-switch 12 will be actuated only when element 8 senses a temperature which is higher than that sensed by element 10.

Many variations, modifications and other applications of the illustrated embodiment will be apparent.

What is claimed is:

1. A differential-temperature sensitive device comprising: a base member; a first lever arm pivotably mounted at one end to said base member; a second lever arm pivotably mounted at one end to the opposite end of the first arm; a first temperature-sensitive element coupled to said first arm to pivot same with respect to the base member in response to the temperature sensed thereby; a second temperature-sensitive element coupled to said second arm to pivot same with respect to said opposite end of the first arm in response to the temperature sensed thereby; and a controlled member fixed to said base member and actuated by said opposite end of said second arm.

2. A device according to claim 1, wherein said controlled member is an electrical switch.

3. A device according to claim 2, wherein said electrical switch is a micro-switch having a casing and a switch operator projecting through the casing, the switch operator being actuated by said opposite end of the second arm.

4. A device according to claim 2, wherein each of said temperature-sensitive elements includes a rod disposed within a sleeve and fixed thereto at one of their ends, the opposite end of each sleeve being fixed to the base member, the opposite end of each rod passing through the base member and coupled to its respective lever arm.

5. A device according to claim 4, wherein said lever arms are substantially parallel to the base member and are coupled to the rods of their respective temperature-sensitive elements by the rod being passed through an opening in the lever arm from the side thereof facing the base member, the rod terminating in an enlarged head at the opposite side of the lever arm, there being a bearing member disposed between each enlarged head and its respective lever arm.

6. A device according to claim 5, wherein each of said enlarged heads includes a nut threaded into said end of the respective rod.

7. A device according to claim 1, wherein said one end of the first lever arm is urged against a pivot on the base member by means of a spring interposed between the opposite end of the first lever arm and the base member.

8. A device according to claim 7, wherein said spring is a coil spring disposed coaxially of a pin fixed to the base member underlying said opposite end of the first lever arm.

9. A device according to claim 7, wherein the second lever arm is pivotably mounted to the first lever arm by means of a bearing interposed between said opposite end of the first lever arm and said one end of the second lever arm.

10. A device according to claim 1, wherein the first lever arm is pivotably mounted to the base member by means of a lug carried by the base member, said lug having a first leg fixed to the base member and a second leg at right angles to the first leg, said one end of the first lever arm engaging the free end of said second leg.

* * * * *